United States Patent [19]

Eberly

[11] Patent Number: 4,895,007

[45] Date of Patent: Jan. 23, 1990

[54] SECURITY DEVICE FOR PADLOCKS

[76] Inventor: David S. Eberly, 5407 Touraune Dr., Tallahassee, Fla. 32808

[21] Appl. No.: 224,844

[22] Filed: Jul. 27, 1988

[51] Int. Cl.[4] ..... E05B 67/38

[52] U.S. Cl. ..... 70/54; 292/104; 292/205; 292/DIG. 32

[58] Field of Search ..... 70/54–56; 292/148, 205, DIG. 29, DIG. 32, 104

[56] References Cited

U.S. PATENT DOCUMENTS

| | | | |
|---|---|---|---|
| 3,514,142 | 5/1970 | Smith | 292/113 |
| 3,606,423 | 9/1971 | McCarthy | 292/148 |
| 3,740,978 | 6/1973 | Smith et al. | 70/55 X |
| 3,802,726 | 4/1974 | Galbreath et al. | 292/DIG. 29 X |
| 3,882,164 | 5/1975 | Galbreath et al. | 292/DIG. 32 X |
| 4,506,528 | 3/1985 | Eberly | 70/54 X |
| 4,548,058 | 10/1985 | Bahry et al. | 70/56 |
| 4,581,907 | 4/1986 | Eberly | 292/205 X |

FOREIGN PATENT DOCUMENTS

| | | | |
|---|---|---|---|
| 2108568 | 5/1983 | United Kingdom | 70/54 |
| 2185519 | 7/1987 | United Kingdom | 70/54 |

*Primary Examiner*—Gary L. Smith
*Assistant Examiner*—Douglas E. Ringel
*Attorney, Agent, or Firm*—Thomas J. Dodd

[57] ABSTRACT

A security device for padlocks used in conjunction with a locking mechanism for a roll-up type truck door. The security device includes a block which has upstanding projecting walls to shield the shackle and housing of the padlock and prevent tampering or unauthorized opening.

1 Claim, 3 Drawing Sheets

SECURITY DEVICE FOR PADLOCKS

SUMMARY OF THE INVENTION

This invention relates to security devices and will have special but not limited application to a security device for protecting a padlock on a roll up truck door.

The padlock security device of this invention includes a one piece block which accommodates the locking mechanism of a conventional roll up type truck door. The block includes a transverse ledge part and generally vertical longitudinal flanges which guard the padlock shackle and housing to safeguard against unauthorized cutting of the padlock.

Accordingly, it is an object of this invention to provide for a security device which protects a padlock on a roll-up type truck door.

Another object of this invention is to provide for a padlock security device which is easily installed and which requires no alterations in a conventional roll-up door locking mechanism.

Another object of this invention is to provide for a padlock security device which is durable, efficient, and economical.

Other objects of this invention will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 3:
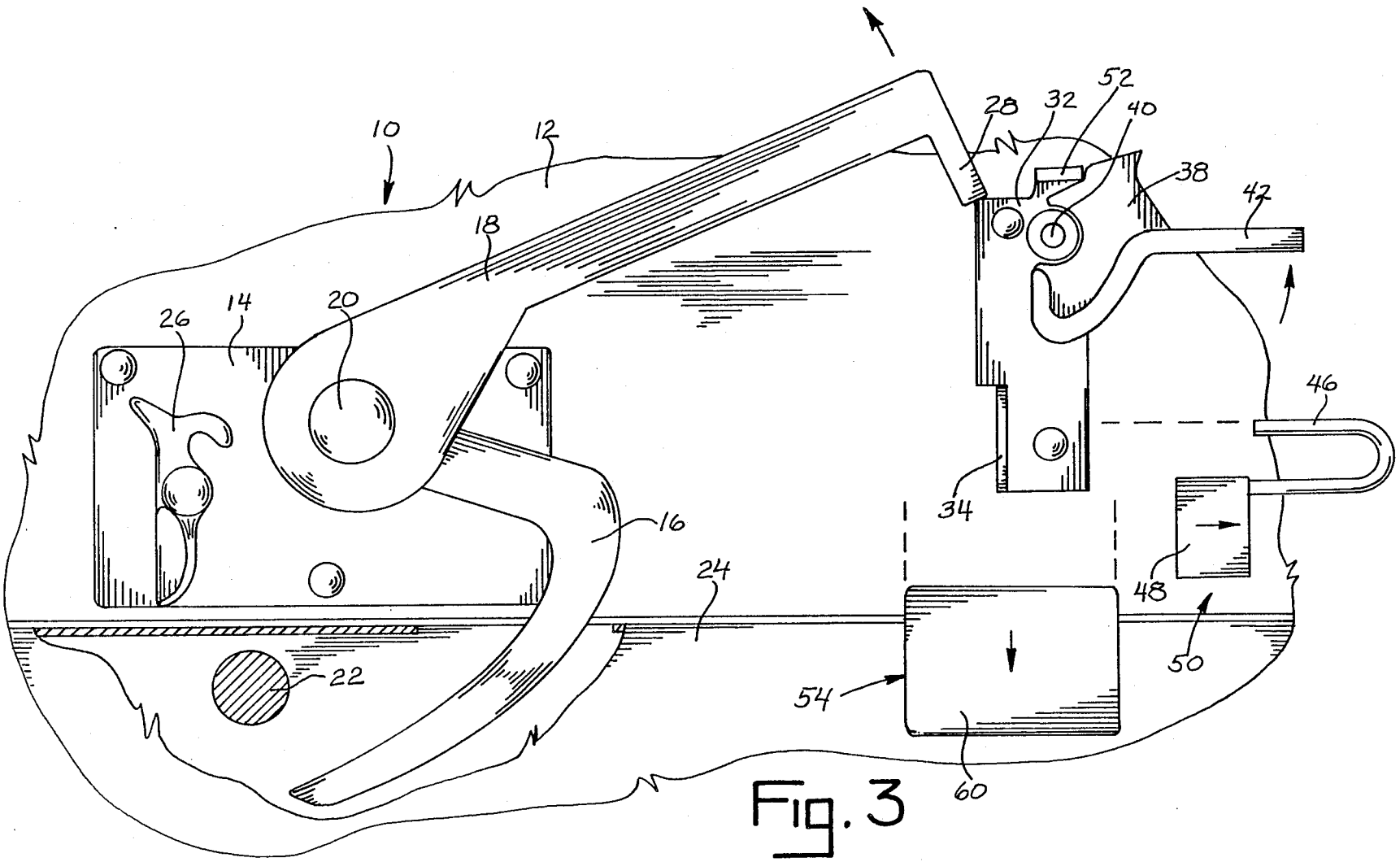
FIG. 3 is a plan view of the lock mechanism of FIG. 1 shown in an unlocked position with the padlock security device about to be installed.
Figure 4:
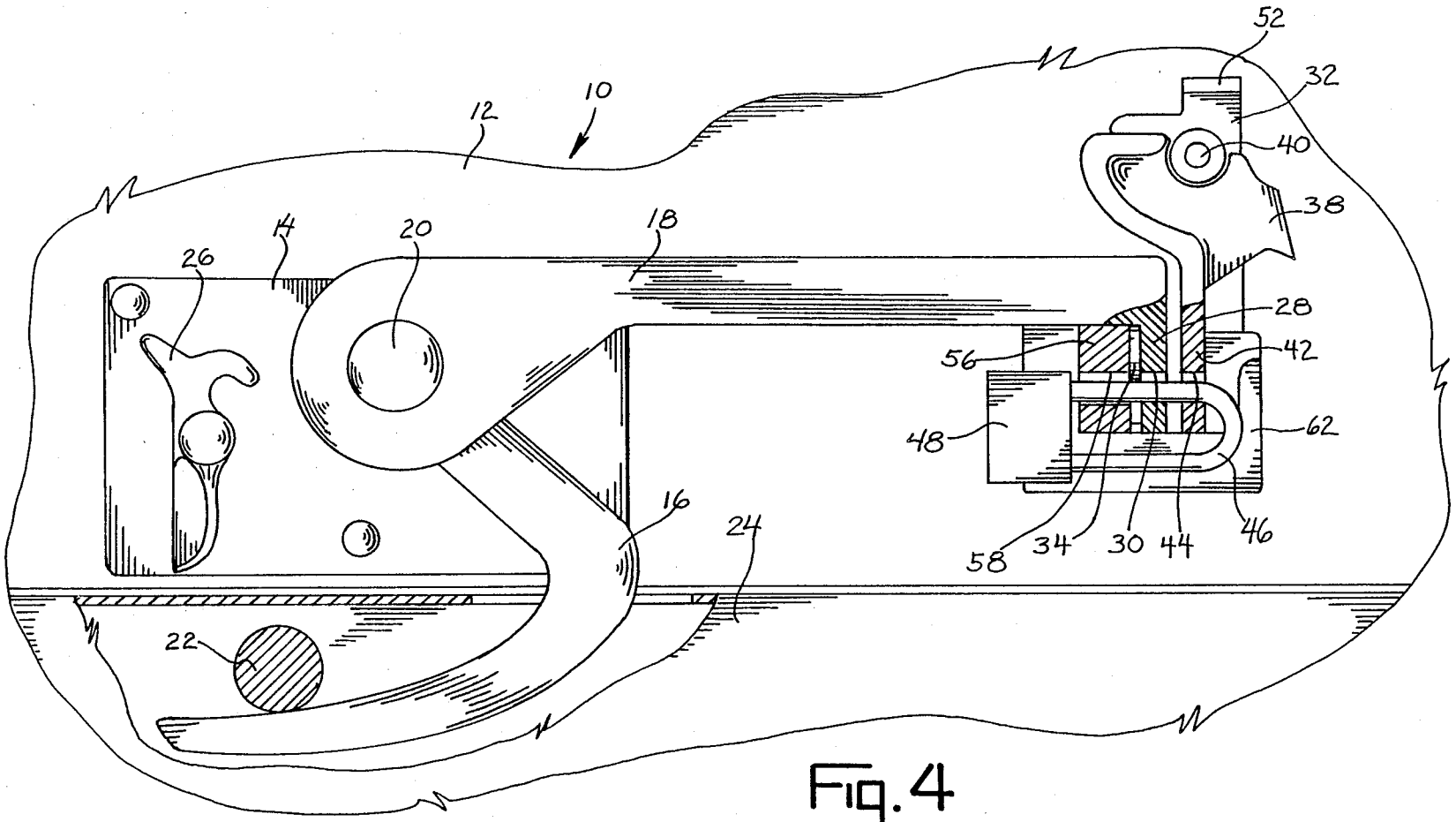
FIG. 4 is a view similar to FIG. 3 showing the lock in the locked position.

Referring now to the drawings, reference numeral 10 refers generally to a locking mechanism for a roll-up type door 12. Mechanism 10 includes a plate 14 fastened to door 12. A curved lock arm 16 and a latching lever 18 are operatively connected to each other and rotatably connected to door 12 by bolt 20. A lock pin 22 extends perpendicularly with respect to mechanism 10 through a bumper 24 positioned below door 12 as shown in FIGS. 3 and 4. Mechanism 10 may also include a catch 26 pivotally fastened to door 12 which secures the lever 18 in a fully unlocked position (not shown). Lever 18 has a downturned distal flange 28 which has a bore 30 therethrough.

Mechanism 10 further includes a catch plate 32 which includes a raised stop flange 34. A locking plate 38 is rotatably connected to door 12 through bolt 40 extending through catch plate 32 and includes a flange 42. Flange 42 has a bore 44 therethrough which aligns with bore 30 to accommodate shackle 46 of padlock 50. Catch plate 32 may include a projection 52 to limit rotational movement of locking plate 38. Padlock 50 also includes housing 48.

Figure 1:
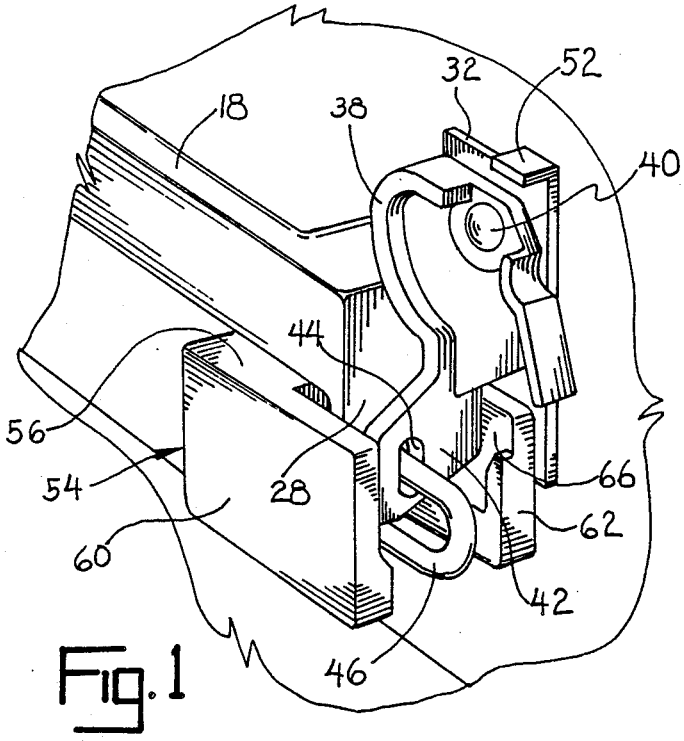
FIG. 1 is a fragmentary perspective view of a roll-up type truck door lock mechanism showing the door in the locked position and the security device of this invention in place.
Figure 2:
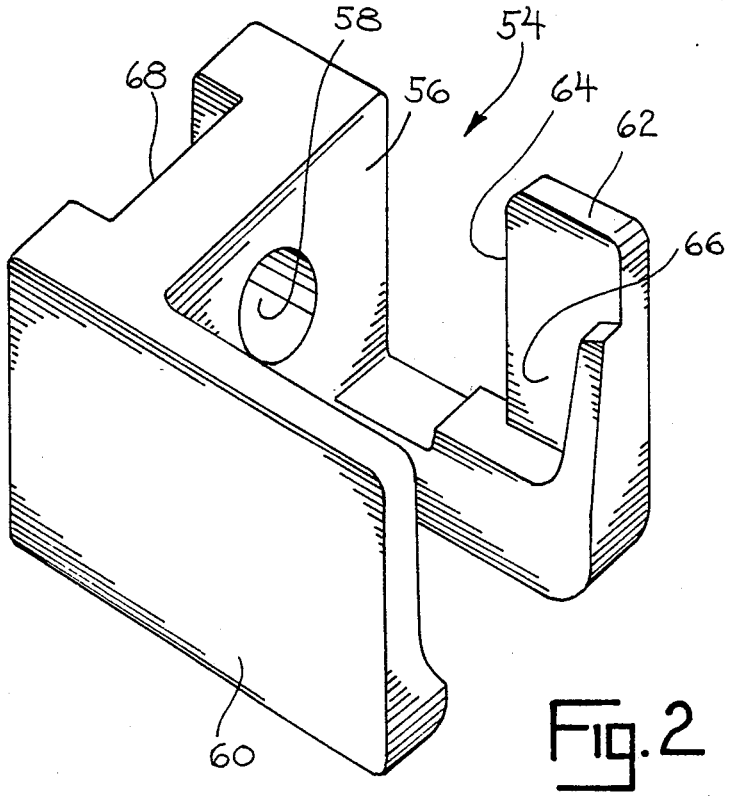
FIG. 2 is a perspective view of the padlock security device.

Padlock security device 54 includes block 56 which has a bore 58 therethrough. Spaced walls 60, 62 extend integrally of block 56 in generally parallel relation to each other. Wall 62 has a transverse slot 64. A notch 66 may be defined in wall 62 as shown in FIG. 2, and bottom notch 68 is defined in block 56.

Padlock security device 54 operates in conjunction with mechanism 10 as follows. With lever 18 in the unlocked position of FIG. 3, lock arm 16 is spaced from lock pin 22 to allow the door 12 to be raised. To lock door 12, lever 18 is pivoted into the locked position of FIG. 4 which urges lock arm 16 under pin 22. Locking plate 38 is then rotated clockwise until bores 30 and 44 are aligned. Security device 54 is then oriented so that wall 62 abuts door 12 and slot 64 is aligned with stop flange 34. Device 54 is positioned adjacent to lever 18 and plate 38 with its block bore 58 aligned with bores 30 and 44. One hasp of padlock shackle 46 is then passed through bores 30, 44, and 58 and pressed into housing 48. In this position, walls 60, 62 shield padlock shackle 46 to prevent tampering and unauthorized opening. Padlock housing 48 is partially enclosed in bottom notch 68 to prevent its being tampered with.

It is to be understood that the above description does not limit the invention to those details which may be modified within the scope of the following claims.

I claim:

1. In combination, a roll-up type truck door including a locking mechanism, and a padlock security device, said truck door locking mechanism including a first latch member pivotally connected to the truck door, and a second latch member pivotally connected to said truck door adjacent said first latch member, a plate having a stop projection positioned adjacent said second latch member, said first and second latch members shiftable between an unlocked position and a mutually cooperable locked position, and a padlock having a housing and a shackle extending through said first and second latch members in the locked position, said padlock security device including a block having a bore therethrough to accept said padlock shackle, two spaced peripheral longitudinal flanges extending outwardly from said block in a parallel orientation, said flanges constituting means for shielding said padlock shackle and housing when the latch members are in their said locked position, and a slot defined in one of said flanges adjacent to said block and positioned between the shackle and the door in the locked position, said slot constituting means for accommodating said second latch member and said plate stop projection when the second latch member is in its said locked position.

* * * * *